US006858366B2

(12) United States Patent
Yamazaki et al.

(10) Patent No.: US 6,858,366 B2
(45) Date of Patent: Feb. 22, 2005

(54) TONER FOR ELECTROSTATIC DEVELOPMENT, CHARGE CONTROLLING AGENT FOR THE TONER AND PROCESS FOR PRODUCING THE SAME

(75) Inventors: Tomomi Yamazaki, Tokyo (JP); Hirofumi Iemura, Tokyo (JP)

(73) Assignee: Toyo Ink Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/119,775

(22) Filed: Apr. 11, 2002

(65) Prior Publication Data

US 2003/0064311 A1 Apr. 3, 2003

(30) Foreign Application Priority Data

Apr. 19, 2001 (JP) ..... 2001-120799

(51) Int. Cl.[7] ..... G03G 9/097
(52) U.S. Cl. ..... 430/108.1; 544/348
(58) Field of Search ..... 430/108.1; 544/348

(56) References Cited

U.S. PATENT DOCUMENTS

| | | | | |
|---|---|---|---|---|
| 3,647,696 | A | | 3/1972 | Olson |
| 4,230,855 | A | | 10/1980 | Capaccioni et al. |
| 4,338,390 | A | | 7/1982 | Lu |
| 4,359,577 | A | | 11/1982 | Granzow et al. |
| 4,376,859 | A | | 3/1983 | Maurer et al. |
| 4,624,709 | A | | 11/1986 | Otsuka |
| 5,281,709 | A | * | 1/1994 | Akiyama et al. ..... 544/348 |
| 5,783,347 | A | * | 7/1998 | Ikami ..... 430/110 |

FOREIGN PATENT DOCUMENTS

| | | |
|---|---|---|
| EP | 0 469 544 A2 | 2/1992 |
| EP | 0 803 780 A1 | 10/1997 |
| JP | 52-135336 | 11/1977 |
| JP | 57-29704 | 6/1982 |
| JP | 2-102269 | 4/1990 |
| JP | 6-230611 | 8/1994 |
| JP | 9-87535 | 3/1997 |
| JP | P2001-11055 A | 1/2001 |

OTHER PUBLICATIONS

Hackh's Chemical Dictionary 4th ed, 1977 pp 337.*
WPI XP–002258253, filed Aug. 19, 1994, KK Canon.
WPI XP–002258254, filed Mar. 31, 1997.
WPI XP–002258255, filed Jan. 16, 2001.
WPI XP–002258256, filed Nov. 12, 1977.
WPI XP–002258257, filed Apr. 13, 1990.

* cited by examiner

*Primary Examiner*—John L Goodrow
(74) *Attorney, Agent, or Firm*—McDermott, Will & Emery

(57) ABSTRACT

A positively charging dry toner for developing an electrostatic latent image including a nigrosine dye or nigrosine pigment containing 500 ppm or less nitrobenzene and 800 ppm or less aniline as a charge controlling agent. The dye or pigment is prepared by dispersing the nigrosine dye or nigrosine pigment obtained by an usual method in a solvent, adding an oxidizing agent such as bleaching powder to the solvent dispersion to conduct oxidation treatment and, if necessary, removing the solvent by steam distillation.

14 Claims, No Drawings

TONER FOR ELECTROSTATIC DEVELOPMENT, CHARGE CONTROLLING AGENT FOR THE TONER AND PROCESS FOR PRODUCING THE SAME

FIELD OF THE INVENTION

The present invention relates to a toner for electrostatic development to be used for developing an electrostatic latent image in an electrostatic copier or a laser beam printer based on the electrophotography or electrostatic recording, a charge controlling agent for use in a toner for developing the electrostatic latent image, and a process for producing the charge controlling agent.

BACKGROUND OF THE INVENTION

Conventional methods for developing an electrostatic latent image formed on an electrostatic charge image carrier such as an electrophotographic photoreceptor or an electrostatic recording body are roughly classified into two types; one being a type of methods using a liquid developer wherein fine toner particles are dispersed in an electrically insulating liquid (wet-process developing method), and the other being a type of methods using toner particles wherein a colorant or a magnetizable powder is dispersed in a binder resin (dry-process developing method). As the dry-process developing method, there are known a method of using a two-component developer comprising carrier particles and a toner and a method of using a single-component developer consisting of a toner (generally a magnetic toner).

Toners for use in development of electrostatic charge images according to the dry-process developing method are commonly produced by using a styrene-based resin or a polyester-based resin as a binder resin, kneading a colorant such as a dye or a pigment into the resin and, after cooling, subjecting the resultant mixture to a pulverizing step and a classifying step. The toner for developing electrostatic charge images commonly has an average particle size of about 1 to about 30 $\mu$m. With magnetic toners, a magnetic powder of magnetite or the like is further used. As the carrier particles to be used in the two-component developers, glass beads, iron powder or magnetite powder coated, if necessary, with a hydrophobic resin are used.

The toners for developing electrostatic charge images as described above are required to maintain positive or negative charge depending upon the polarity of the electrostatic latent image to be developed. In order to maintain electric charge on the toner for developing the electrostatic charge image, triboelectric properties of toner components such as a binder resin may be utilized. However, triboelectric charge alone is generally insufficient in electrostatic charge amount and is unstable in polarity, and hence images obtained by development utilizing only triboelectric charge tend to be fogged and blurred. Therefore, in order to impart desirable charging properties to a toner, it is common to add a substance called a charge controlling agent to the toner.

Typical examples of conventional charge controlling agents include those which impart positively charging properties to a toner such as basic dyes (e.g., nigrosine dyes (Japanese Examined Patent Publication No. S48-25669) and triarylmethane dyes), quaternary ammonium salts (Japanese Unexamined Patent Publication No. S57-119364), organic tin oxides (Japanese Examined Patent Publication No. S57-29704) and electron donative substances such as amino group-containing polymers; and those which impart negatively charging properties to a toner exemplified by metal-containing dyes such as metal complexes of monoazo dyes and chromium-containing organic dyes (e.g., Copper Phthalocyanine Green, chromium-containing monoazo dyes, etc.).

In recent years, as photoreceptors for electrophotographic copiers or printers, organic photoreceptors have popularly been used and, as a developer for copiers or the like using the organic photoreceptors, positively charging toners have been required. However, many of positive charge-imparting charge controlling agents to be used for producing such positively charging toners are hydrophilic and, under the condition of a high humidity, they tend to cause reduction in charge quantity, whereas many of those which do not cause reduction in charge quantity under highly humid conditions cause the problem that there results an unnecessarily high charge quantity under the condition of a low humidity. For example, triarylmethane dyes tend to cause reduction in charge quantity under the conditions of a high temperature and a high humidity, though they show excellent positively charging properties under the conditions of an ordinary temperature and an ordinary humidity and, with respect to particularly selected toner components, they might generate non-uniform charge under the conditions of a low temperature and a low humidity. Quaternary ammonium salts have a low charge-imparting ability, and there might result a decrease in image density with an increase in number of produced copies under the conditions of a high temperature and a high humidity.

On the other hand, nigrosine dyes have high charge-imparting properties and are therefore comparatively excellent charge controlling agents, but they show such a poor dispersibility in a toner resin that they are difficult to be uniformly dispersed. In addition, the charging property and thermal property of a toner largely vary depending upon the process for their production, and it is difficult to obtain charge controlling agents fully satisfying conditions required for charge controlling agents—for example, there results a decrease in image density, fogging is liable to occur, or a problem of dusting of toner particles inside of a copier arises. In order to dissolve these problems, there are proposed techniques of lake-formation and acid-modification of nigrosine dyes (Japanese Unexamined Patent Publication No. H3-13186). However conducting such treating, there might result a decrease of dispersibility of charge controlling agent in a toner or fluidity of a toner.

Toners using the nigrosine dye or the nigrosine pigment involve another problem that, when a large amount of the toner is replenished at once to a developer vessel upon replenishing the toner, there results a temporary reduction in image density and the image density does not return to the level before replenishment of the toner until several tens to several hundreds of copies are produced. Further, the toners involve the problem that they suffer deterioration of characteristic properties due to heat stress to be applied thereto during storage.

As is described above, the nigrosine dyes and the nigrosine pigments involve many problems, though they are comparatively excellent charge controlling agents. Thus, there have been required a charge controlling agent which solve these problems, which provides an enough high charge quantity, which shows less dependence upon temperature and humidity upon development, which suffers less deterioration in toner characteristic due to heat stress to be applied thereto before use, which shows a good dispersibility in a binder resin, shows excellent developing properties, and which shows excellent lasting properties, and a positively charging toner containing the same.

SUMMARY OF THE INVENTION

An object of the present invention is to provide a positively charging toner for developing electrostatic charge images having no problem described above, i.e., a positively charging toner for developing electrostatic charge images which generates a large quantity of triboelectric charge between the toner and the carrier or between the toner and the toner carrier such as a development sleeve, which is stable, which is not affected by temperature and humidity, and which can form a stable toner image.

Another object of the invention is to provide a positively charging toner for developing electrostatic charge images which generates a stable amount of triboelectric charge even when the number of copied products increases, and which does not cause fogging and dusting of toner particles inside of a copier.

A further object of the invention is to provide a positively charging toner for developing electrostatic charge images which contains a nigrosine dye or a nigrosine pigment as a charge controlling agent, in which the nigrosine dye or the nigrosine pigment is uniformly dispersed, and which can form a distinct image with no fog.

A still further object of the invention is to provide a positively charging toner for developing electrostatic charge images which contains a nigrosine dye or a nigrosine pigment, and which does not suffer deterioration in toner characteristic due to heat stress during storage of the toner.

A still further object of the invention is to provide a charge controlling agent to be used for producing a toner for developing electrostatic charge images having the above-described excellent properties.

A yet further object of the invention is to provide a process for producing the charge controlling agent described above.

As a result of intensive investigations, the inventors have found that the above-described objects can be attained by using as a charge controlling agent a nigrosine dye or a nigrosine pigment purified according to a specific purifying process and containing nitrobenzene and aniline in extremely low contents, thus having achieved the invention based on the finding.

That is, the present invention relates to a toner for developing electrostatic charge images containing at least a binder resin, a colorant and a charge controlling agent, which contains as a charge controlling agent a nigrosine dye or a nigrosine pigment containing 500 ppm or less nitrobenzene and 800 ppm or less aniline.

The invention further relates to the toner for developing electrostatic charge images described above, wherein the nigrosine dye or the nigrosine pigment containing 500 ppm or less nitrobenzene and 800 ppm or less aniline is that obtained by dispersing the nigrosine dye or the nigrosine pigment in a solvent, and adding thereto an oxidizing agent to conduct oxidation treatment.

The invention further relates to a charge controlling agent to be used for the toner for developing electrostatic charge images, which comprises a nigrosine dye or a nigrosine pigment containing 500 ppm or less nitrobenzene and 800 ppm or less aniline.

The invention further relates to a process for producing a nigrosine dye or a nigrosine pigment, which comprises dispersing a nigrosine dye or a nigrosine pigment in a solvent, and adding thereto an oxidizing agent to conduct oxidation treatment to thereby produce a nigrosine dye or a nigrosine pigment containing 500 ppm or less nitrobenzene and 800 ppm or less aniline.

The invention further relates to a process for producing a nigrosine dye or a nigrosine pigment, which comprises dispersing a nigrosine dye or a nigrosine pigment in a solvent, adding thereto an oxidizing agent, then subjecting the dispersion to steam distillation to thereby produce a nigrosine dye or a nigrosine pigment containing 500 ppm or less nitrobenzene and 800 ppm or less aniline.

DETAILED DESCRIPTION OF THE INVENTION

The invention is described in more detail below.

As is described hereinbefore, it has been known to use a nigrosine dye or a nigrosine pigment as a positive charge-imparting charge controlling agent for a toner for developing electrostatic charge images. The nigrosine dye is a bluish black to black dye produced by heating aniline and nitrobenzene to 160° C. to 180° C. in the presence of iron chloride, iron and hydrochloric acid. After completion of the reaction, an alkali aqueous solution is added to the reaction solution to neutralize it, then the dye aniline layer is separated out, and treated with an alkali to make the layer basic, followed by washing with water, filtering, drying and pulverizing to obtain a charge controlling agent. By basifying, the nigrosine is made water-insoluble and scarcely influenced by humidity.

However, a toner for developing electrostatic charge images using the thus produced charge controlling agent suffers a decrease in image density with an increase in number of copied products and, in some cases, there occur fogging and toner dusting inside of a copier, as has been described hereinbefore. The nigrosine dye or pigment commonly contains a considerable quantity of nitrobenzene used for producing the nigrosine dye. Nitrobenzene has such a high specific inductive capacity that, when remaining in the nigrosine dye or nigrosine pigment in a large amount, electric charge is stored within the nigrosine dye or the nigrosine pigment due to polarization of nitrobenzene, thus the nigrosine dye or the nigrosine pigment being liable to agglomerate, leading to deterioration in dispersibility or distributability of nigrosine. It has now been found that, when the content of nitrobenzene in the nigrosine dye or the nigrosine pigment is reduced to 500 ppm or less, there is produced a toner wherein the nigrosine dye or the nigrosine pigment is well dispersed or distributed in a binder resin. It has also been found that, when the content of aniline in the nigrosine dye or the nigrosine pigment is additionally reduced to 800 ppm or less, there is produced a toner for developing electrostatic charge images having more excellent properties.

Such nigrosine dye or nigrosine pigment containing 500 ppm or less nitrobenzene and 800 ppm or less aniline can be produced by dispersing in a solvent a nigrosine dye or a nigrosine pigment having been produced by a common process, and adding an oxidizing agent thereto to conduct oxidation treatment, followed by removing nitrobenzene with a solvent. When steam distillation is conducted after the addition of the oxidizing agent, there can be obtained a charge controlling agent with more preferred properties. The nigrosine dye or the nigrosine pigment having the above-described properties can not be produced by the conventional purifying process such as a process of merely dispersing the nigrosine dye or the nigrosine pigment in a solvent without using any oxidizing agent, and subjecting the dispersion to the steam distillation or a process of treating the nigrosine dye or the nigrosine pigment with a solvent, followed by vacuum drying.

Preferred examples of the oxidizing agent to be used in the process for producing the charge controlling agent of the invention include bleaching powder and sodium hypochlorite. As the solvent, those which have a boiling point of 100° C. or lower than that are preferred, since they permit to reduce the amount thereof remaining in the nigrosine. As such low-boiling solvents, methanol and ethanol are preferred.

The amount of the nigrosine dye or the nigrosine pigment to be used in the toner of the invention for developing electrostatic charge images is generally 0.1 to 10 parts by weight, preferably 0.5 to 5 parts by weight, more preferably 0.8 to 3 parts by weight, based on 100 parts by weight of a binder resin, though it varies depending upon the kind of the binder resin to be used. As to particle size, it suffices for the nigrosine dye or the nigrosine pigment to have a volume average particle size of 50 μm or less, with 12 μm or less being more preferred. Further, the content of nitrobenzene in the nigrosine dye or the nigrosine pigment is preferably 300 ppm or less, more preferably 100 ppm or less. Also, the content of aniline in the nigrosine dye or the nigrosine pigment is preferably 750 ppm or less, more preferably 500 ppm or less. As to the amount of remaining solvent in the nigrosine dye or the nigrosine pigment, the smaller is the better.

In the toner of the present invention for developing electrostatic charge images, other charge controlling agents may be used together with the nigrosine dye or the nigrosine pigment for imparting positively charging properties to the toner as a supplement charge controlling agent. As such charge controlling agents, any of those which have conventionally been known to be able to impart positively charging properties to a toner may be used. Among those, quaternary ammonium salts and basic dyes of triphenylmethane type dyes are preferred.

As constituents of the toner of the present invention for developing electrostatic charge images other than the charge controlling agents of the present invention, there may be used a binder resin and a colorant, which are known materials for constituting a toner. In the case of obtaining a magnetic toner, a magnetic powder is further used. In this case, the magnetic powder may also be utilized as a colorant. Thus, in the present invention, the colorant includes the magnetic powder. To the toner for developing electrostatic charge images may further be internally or externally added, as required, a release agent, a lubricant, a fluidity-improving agent, an abrasive, an electric conductivity-imparting agent, an anti-peeling agent, etc. In addition, as a charge controlling agent, other positively chargeable charge controlling agents than the charge controlling agents of the present invention may be used within a range of attaining the objects of the present invention.

As the binder resin to be used in the toner of the present invention for developing electrostatic charge images, any of those which have conventionally been known as binder resins for toners for developing electrostatic charge images may be used. Examples of usable binder resins include homopolymers of styrene and the derivative thereof, such as polystyrene, poly-p-chlorostyrene and polyvinyltoluene; styrene-styrene derivative copolymers such as styrene-p-chlorostyrene copolymer and styrene-vinyltoluene copolymer; styrenic copolymers such as styrene-vinylnaphthalene copolymer, styrene-acrylic acid type copolymers, styrene-methacrylic acid type copolymers, styrene-methyl α-chloromethacrylate copolymer, styrene-acrylonitrile copolymer, styrene-vinyl methyl ether copolymer, styrene-vinyl ethyl ether copolymer, styrene vinyl methyl ketone copolymer, styrene-butadiene copolymer, styrene-isoprene copolymer and styrene-acrylonitrile-indene copolymer; polyvinyl chloride; phenol resin, natural resin-modified phenol resin; natural resin-modified maleic acid resin; acrylic resin; methacrylic resin; polyvinyl acetate; silicone resin; polyester resin; polyurethane; polyamide resin; furan resin; epoxy resin; xylene resin; polyvinylbutyral; terpene resin; coumarone-indene resin; and petroleum-based resin.

Of these, styrene homopolymer, styrene-styrene derivative copolymers, styrene-acrylic acid type copolymers and styrene-methacrylic acid type copolymers are particularly preferred.

As comonomers for styrene monomer in the styrene-acrylic acid type copolymers and the styrene-methacrylic acid type copolymers, there are illustrated, for example, acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate and octyl methacrylate.

Crosslinked styrenic copolymers are also preferred binder resins. As comonomers to be used together with styrene for producing the crosslinked styrenic copolymers, there are used monocarboxylic acids having a double bond or the substituted derivatives thereof such as acrylonitrile, methacrylonitrile and acrylamide as well as the above-described styrene derivatives, acrylic acid, methacrylic acid, acrylic acid esters and methacrylic acid esters; dicarboxylic acids and the substituted derivatives thereof such as maleic acid, methyl maleate, butyl maleate and dimethyl maleate; vinyl chloride; vinyl esters such as vinyl acetate and vinyl benzoate; ethylenic olefins such as ethylene, propylene and butylene; vinyl ketones such as vinyl methyl ketone and vinyl hexyl ketone; vinyl ethers such as vinyl methyl ether, vinyl ethyl ether and vinyl isobutyl ether; and like vinyl monomers alone or in combination of two or more.

As the crosslinking agent, there may mainly be used compounds having two or more polymerizable double bonds. For example, aromatic divinyl compounds such as divinylbenzene and divinylnaphthalene; carboxylic acid esters having two double bonds such as ethylene glycol diacrylate, ethylene glycol dimethacrylate, 1,3-butanediol dimethacrylate, polyethylene glycol diacrylate and polyethylene glycol dimethacrylate; divinyl compounds such as divinylaniline, divinyl ether, divinyl sulfide and divinyl sulfone; and compounds having three or more double bonds are used alone or as a mixture thereof. These crosslinking agents are used in an amount of from about 0.01 to about 5 parts by weight, more preferably from about 0.03 to about 3 parts by weight, based on 100 parts by weight of other monomer components.

In view of fixing properties, styrenic copolymers having a molecular weight distribution wherein at least one peak exists in the region of $3\times10^3$ to $5\times10^4$ in molecular weight measured by GPC and at least one peak or shoulder in the region of $10^5$ or more are preferred. The binder resin having such molecular weight distribution can be produced by mixing two or more resins different from each other in molecular weight, or by using the above-described crosslinking agent to prepare a crosslinked resin.

Additionally, the molecular weight distribution according to GPC is measured, for example, under the following conditions.

A column is stabilized in a heat chamber at 40° C., tetrahydrofuran (THF) solvent is caused to flow through the column at that temperature at a rate of 1 ml/min, and about 100 μl of a sample solution in THF is injected. In measuring molecular weight of a sample, the identification of the molecular weight distribution of the sample is performed based on a calibration curve obtained by using several monodisperse polystyrene standard samples and having a logarithmic scale of molecular weight versus count number.

As the standard polystyrene samples for preparation of the calibration curve, it is appropriate to use those having a molecular weight of about $10^2$ to $10^7$ and manufactured by, for example, Toso K. K. or Showa Denko K. K. and use at least 10 standard polystyrene samples. The detector may be an RI (refractive index) detector. Additionally, it is appropriate to constitute the column as a combination of several commercially available polystyrene gel columns. For example, there are illustrated a combination of Shodex GPC KF-801, 802, 803, 804, 805, 806, 807 and 800P manufactured by Show Denko K. K. or a combination of TSK gel G1000H (HXL), TSK gel G2000H(HXL), TSK gel G3000H (HXL), TSK gel G4000H(HXL), TSK gel G5000H(HXL), TSK gel G6000H(HXL), TSK gel G7000H(HXL), and TSK guard column manufactured by Toso K. K.

A sample for the measurement is prepared in the following manner. That is, the sample is placed in THF and, after leaving for several hours, the resultant mixture is well shook to mix till the sample coalescence disappears, followed by allowing to stand for further 12 hours. In this occasion, the time for leaving the sample in THF is adjusted to be 24 hours or longer. Then, the mixture is passed through a sample-treating filter (pore size: 0.45 to 0.5 $\mu$m; for example, My Shori Disc H-25-5 made by Toso K. K. or Ekikuro Disc 25CR made by German Science Japan being utilizable) to prepare a sample for GPC. The sample concentration is adjusted to be 0.5 to 5 mg/ml of the resin component.

Additionally, in producing the vinyl polymers, polymerization initiators are used. As such polymerization initiators, any of those which have conventionally been used usually may be used. As the polymerization initiator, there are preferably used, for example, benzoyl peroxide, lauroyl peroxide, t-butyl hydroperoxide, t-butyl peroxybenzoate, di-t-butyl peroxide, cumene hydroperoxide, dicumyl peroxide, azoisobutyronitrile and azobisvaleronitrile. The initiator is used in an amount of generally from 0.2 to 5% by weight based on the weight of the vinyl monomer. Polymerization degree is properly selected depending upon kinds of the monomer and the initiator to be used.

In addition, polyester resins are also preferred as binder resins for the toner of the invention for developing electrostatic charge images. As the polyester resin-constituting alcohol component, there are illustrated diols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenol derivatives represented by the following general formula 1:

(1)

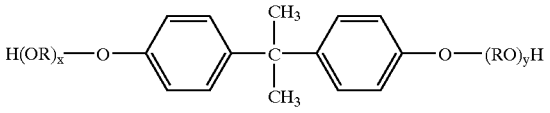

(wherein R represents an ethylene group or a propylene group, x and y each represent an integer of 1 or more, with the average value of x+y being 2 to 10) and polyhydric alcohols such as glycerin, sorbitol and sorbitan.

The acid component includes dicarboxylic acids such as benzenedicarboxylic acids or the anhydrides thereof (e.g., phthalic acid, terephthalic acid, isophthalic acid, phthalic anhydride, etc.), alkyldicarboxylic acids (e.g., succinic acid, adipic acid, sebacic acid, azelaic acid, etc.), succinic acids substituted by an alkyl group having 16 to 18 carbon atoms or the anhydrides thereof, and unsaturated dicarboxylic acids or the anhydrides thereof (e.g., fumalic acid, maleic acid, citraconic acid, itaconic acid, etc.); and carboxylic acids having three or more carboxyl groups such as trimellitic acid, pyromellitic acid, benzophenonetetracarboxylic acid and the anhydrides thereof.

Preferred alcohol components include the bisphenol derivatives represented by the foregoing general formula 1, and preferred acid components include dicarboxylic acids such as phthalic acid, terephthalic acid, isophthalic acid or the anhydrides thereof, succinic acid, n-dodecenylsuccinic acid or the anhydrides thereof, fumaric acid, maleic acid and maleic anhydride; and tricarboxylic acids such as trimellitic acid or the anhydride thereof.

Further, in the case of employing a pressure-fixing system, binder resins for toners adapted for pressure fixing may be used as well. For example, there are illustrated polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyester, paraffin, etc.

As colorants usable in the toner of the invention for developing electrostatic charge images, any of those colorants which have conventionally been known to be used for producing toners may be used, and examples thereof include metal salts of fatty acids and various dyes and pigments such as carbon black, phthalocyanine dyes and pigments, rhodamine dyes and pigments, quinacridone dyes and pigments, triarylmethane dyes and pigments, anthraquinone dyes and pigments, azo dyes and pigments and diazo dyes and pigments. These may be used alone or as a mixture of two or more.

Magnetic powders to be used in the toner of the invention for developing electrostatic charge images may be any of those powders including alloys or compounds containing ferromagnetic elements, which have conventionally been used for producing magnetic toners. Examples of such magnetic powders include powders of iron oxide or compounds between a divalent metal and iron oxide such as magnetite, maghemite and ferrite; metals such as iron, cobalt and nickel; alloys between such metal and a metal of aluminum, cobalt, copper, lead, magnesium, tin, zinc, antimony, beryllium, bismuth, cadmium, calcium, manganese, selenium, titanium, tungsten or vanadium; and a mixture thereof. These magnetic powders have an average particle size of from about 0.1 to about 2 $\mu$m, preferably from about 0.1 to about 0.5 $\mu$m. The amount of the magnetic powder in a toner is from about 20 to about 200 parts by weight, preferably from 40 to 150 parts by weight, based on 100 parts by weight of the thermoplastic resin. The toner has a saturation magnetization of preferably 15 to 35 emu/g (magnetic field for measurement: 1 kOe).

The toner of the invention may be mixed with a carrier to be used as a two-component developer. As a carrier to be used together with the toner of the invention, any of conventionally known carriers may be used. Examples of usable carriers include magnetic powders such as iron powder, ferrite powder and nickel powder; glass beads; and resin-coated products thereof. Resins for coating the surface of the carriers include styrene-acrylic ester copolymer, styrene-methacrylic ester copolymer, acrylic ester copolymer, methacrylic ester copolymer, fluorine-containing resin, silicon-containing resin, polyamide resin, ionomer resin, polyphenylene sulfide resin, and a mixture thereof. Of these, fluorine-containing resin and silicon-containing resin are particularly preferred since they form a less amount of spent toner.

The toner of the invention for developing electrostatic charge images has a weight-average molecular weight of desirably 1 to 30 μm, preferably 3 to 15 μm. In particular, a toner which contains 12 to 60% in number of toner particles having a particle size of 5 μm or less, 1 to 33% in number of toner particles having a particle size of 8 to 12.7 μm, and 2.0% by weight of toner particles having a particle size of 16 μm or less and which has a weight-average particle size of 4 to 10 μm is more preferred in view of developing characteristic. Additionally, the particle size distribution of the toner can be measured by using, for example, a Coulter counter.

To the toner of the invention may further be added as desired, internally or externally, those known additives which are used for producing toners, such as a release agent, a lubricant, a fluidity-improving agent, an abrasive, an electric conductivity-imparting agent and an ant-peeling agent. Examples of the release agent include wax materials such as low molecular weight polyethylene, low molecular weight polypropylene, microcrystalline wax, carnauba wax, Sazole wax and paraffin wax. These are added to the toner in an amount of commonly from about 0.5 to about 5% by weight. Examples of the lubricant include polyvinylidene fluoride and zinc stearate. Examples of the fluidity-improving agent include silica manufactured by a dry process or a wet process, aluminum oxide, titanium oxide, silicon aluminum co-oxide, silicon titanium co-oxide, and those prepared by subjecting these to hydrophobicity-imparting treatment. Examples of the abrasive include silicon nitride, cerium oxide, silicon carbide, strontium titanate, tungsten carbide, calcium carbonate, and those prepared by subjecting these to hydrophobicity-imparting treatment. Examples of the electric conductivity-imparting agent include carbon black and tin oxide. In addition, fine powder of a fluorine-containing polymer such as polyvinylidene fluoride is preferred in view of fluidity, abrasive properties and charge stability.

In the invention, it is preferred to use a fine powder of silica having been subjected to the hydrophobicity-imparting treatment, aluminum oxide having been subjected to the hydrophobicity-imparting treatment, silicon aluminum co-oxide having been subjected to the hydrophobicity-imparting treatment or silicon titanium co-oxide having been subjected to the hydrophobicity-imparting treatment as an external additive. As the hydrophobicity-imparting treatment for the silicon fine powder, there are illustrated a treatment with a silicone oil or a silane coupling agent such as dichlorodimethylsilane, hexamethyldisilazane or tetramethyldisilazane. Further it is preferred to use positively charging silica showing positive triboelectric charge against an iron powder carrier when measured according to the blow-off method. Such positively charging chargeable silica may be obtained by treating with a silicone oil having an organic group containing at least one nitrogen atom in the side chain or a silane coupling agent containing nitrogen atom. The amount of the silica fine powder having been subjected to the hydrophilicity-imparting treatment is 0.01 to 20%, preferably 0.03 to 5%, based on the weight of the developer.

The toner in accordance with the invention can be produced by a conventionally known process for producing a toner. It is generally preferred to sufficiently mix the above-described toner-constituting materials in a mixer such as a ball mill or a Henschel mixer, well knead the mixture using a heat kneader such as a hot role kneader or a monoaxial or biaxial extruder, cool the kneaded product to solidify, mechanically roughly crush the solid product by use of a crusher such as a hammer mill, then finely pulverizing the crushed product in a jet mill or the like, followed by classification. However, the process for producing the toner is not limited to this, and other processes such as a process of dispersing toner-constituting materials other than a binder resin in a solution of the binder resin and spray-drying the dispersion, a process of producing a toner by a so-called microencapsulation technique, and a process of producing a toner by polymerization technique comprising mixing predetermined materials in a binder resin-forming monomer and conducting emulsion polymerization or suspension polymerization may freely be employed.

Further, it is also possible to sufficiently mix, as desired, a classified toner with an external additive in a Henschel mixer to thereby produce the toner of the invention for developing electrostatic charge images.

The toner of the invention for developing electrostatic charge images can be used as a preferred developer in any conventionally known process or any conventionally known apparatus for forming a dry toner image according to electrophotography, electrostatic recording or electrostatic printing.

The present invention is now described in more detail by reference to Examples that, however, do not limit the invention in any way.

EXAMPLE 1

One hundred g of nigrosine dye A produced by a conventional process (content of nitrobenzene: 2,000 ppm; content of aniline: 9,300 ppm) was added to 1,000 g of methanol and sufficiently stirred to disperse and, after adding thereto 4 g of bleaching powder, steam distillation of the mixture was conducted for 3 hours. Then, the reaction solution was filtered to obtain purified nigrosine dye. After washing with water, the resultant nigrosine dye was heat-dried under reduced pressure in a vacuum drier, followed by pulverizing in a pulverizing machine to obtain nigrosine dye B having an average particle size of 7.1 μm. The resultant nigrosine dye B contained 50 ppm of nitrobenzene, 450 ppm of aniline, and 80 ppm of the residual solvent (methanol).

Additionally, nitrobenzene content, aniline content, and residual solvent content in nigrosine in Examples and Comparative Examples were measured by using gas chromatograph GC-14B (made by Shimazu Seisakusho K. K.) and Chromato Pack C-R6A (made by Shimazu Seisakusho K. K.) and using as columns DB-WAX (length: 30 m; L.D.: 0.53 mm; film: 1 μm).

EXAMPLE 2

One hundred g of nigrosine dye A was added to 1,000 g of methanol and sufficiently stirred to disperse, and after adding thereto 4 g of sodium hypochlorite, steam distillation of the mixture was conducted for 3 hours. Then, the reaction solution was filtered to obtain purified nigrosine dye. After washing with water, the resultant nigrosine dye was heat-dried under reduced pressure in a vacuum drier, followed by pulverizing in a pulverizing machine to obtain nigrosine dye C having an average particle size of 6.8 μm. The resultant nigrosine dye C contained 100 ppm of nitrobenzene, 500 ppm of aniline, and 90 ppm of the residual solvent (methanol).

EXAMPLE 3

One hundred g of nigrosine dye A was added to 1,000 g of methanol and sufficiently stirred to disperse, and 4 g of bleaching powder was added thereto, followed by sufficient mixing and stirring. Then, the reaction solution was filtered to obtain purified nigrosine dye. After washing with water, the resultant nigrosine dye was heat-dried under reduced pressure in a vacuum drier, followed by pulverizing in a pulverizing machine to obtain nigrosine dye D having an average particle size of 6.6 μm. The resultant nigrosine dye D contained 450 ppm of nitrobenzene, 750 ppm of aniline, and 350 ppm of the residual solvent (methanol).

Comparative Example 1

One hundred g of nigrosine dye A was added to 1,000 g of xylene and sufficiently stirred to disperse, the solution was filtered, and the residue was heat-dried under reduced pressure in a vacuum drier, followed by pulverizing in a pulverizing machine to obtain nigrosine dye E having an average particle size of 6.9 μm. The resultant nigrosine dye E contained 400 ppm of nitrobenzene, 900 ppm of aniline, and 2,000 ppm of the residual solvent (xylene).

Comparative Example 2

100 g of nigrosine dye A was added to 1,000 g of ethanol and sufficiently stirred to disperse, the solution was filtered, and the residue was heat-dried under reduced pressure in a vacuum drier, followed by pulverizing in a pulverizing machine to obtain nigrosine dye F having an average particle size of 7.2 μm. The resultant nigrosine dye F contained 500 ppm of nitrobenzene, 2,800 ppm of aniline, and 1,000 ppm of the residual solvent (ethanol).

Comparative Example 3

Nigrosine dye A was heat-dried for 24 hours under reduced pressure in a vacuum drier to obtain nigrosine dye G. The resultant nigrosine G had an average particle size of 14.1 μm, and contained 1,000 ppm of nitrobenzene and 5,000 ppm of aniline.

Comparative Example 4

100 g of nigrosine dye A was added to 1,000 g of methanol and sufficiently stirred to disperse, followed by conducting steam distillation for 3 hours. The residue was filtered out and was heat-dried under reduced pressure in a vacuum drier, followed by pulverizing in a pulverizing machine to obtain nigrosine dye H having an average particle size of 7.0 μm. The resultant nigrosine dye H contained 400 ppm of nitrobenzene, 950 ppm of aniline, and 100 ppm of the residual solvent (methanol).

The nitrobenzene contents, aniline contents and residual solvent contents of nigrosine dyes A to H described above are tabulated in the following Table 1.

TABLE 1

| | Nitrobenzene Content (ppm) | Aniline Content (ppm) | Content of Residual Solvent (ppm) |
|---|---|---|---|
| Nigrosine dye A | 2000 | 9300 | Non-treated |
| Nigrosine dye B | 50 | 450 | 80(methanol) |
| Nigrosine dye C | 100 | 500 | 90(methanol) |
| Nigrosine dye D | 450 | 750 | 350(methanol) |

TABLE 1-continued

| | Nitrobenzene Content (ppm) | Aniline Content (ppm) | Content of Residual Solvent (ppm) |
|---|---|---|---|
| Nigrosine dye E | 400 | 900 | 2000(xylene) |
| Nigrosine dye F | 500 | 2800 | 1000(ethanol) |
| Nigrosine dye G | 1000 | 5000 | Non-treated |
| Nigrosine dye H | 400 | 950 | 100(methanol) |

It is seen from Table 1 that a nigrosine dye containing 500 ppm or less amount of nitrobenzene and 800 ppm or less amount of aniline can be produced only by treating the nigrosine dye with an oxidizing agent. It is also seen that the treatment with an oxidizing agent is preferably combined with steam distillation since the contents of nitrobenzene, aniline and the residual solvent are more reduced by distilling off the solvent by steam distillation, and that a solvent having a boiling point of 100° C. or lower is preferred since combination of the steam distillation and a solvent having a boiling point of 100° C. or less serves to provide a nigrosine dye containing a less amount of the solvent.

EXAMPLE 4

| | |
|---|---|
| Styrene-n-butyl acrylate copolymer | 56 parts by weight |
| Magnetic iron oxide | 40 parts by weight |
| Nigrosine dye B | 2 parts by weight |
| Low molecular weight polypropylene wax | 2 parts by weight |

The above-described components were mixed in a Henschel mixer, then charged in a biaxial heating kneader, and the thus kneaded and extruded mixture was cooled at room temperature, followed by coarsely crushed with a hammer mill to obtain chip-like crushed product (hereinafter referred to as "chips"). Then, the chips were finely pulverized using a jet mill pulverizer, and guided to a classifier to take out a portion having an average particle size of 9 μm as a fine powder for a toner, thus a magnetic toner (classified toner mother powder) being obtained.

In order to examine distributing properties of the nigrosine in the binder resin, a predetermined amount of chips, a predetermined amount of classified toner mother particles and a predetermined amount of the classified fine powder were respectively dissolved in a predetermined amount of chloroform, and absorbance (wavelength: 567 nm) of the supernatant liquid of each solution was measured, and the nigrosine contents in the chips, classified toner mother powder and the classified fine powder were determined from the values of a calibration curve. The nigrosine contents were determined to be 2.01%, 2.00% and 2.01%, respectively.

Additionally, the calibration curve was prepared as follows. Magnetic toners containing different amounts of nigrosine dye and binder resin were prepared in the same manner as in the above Examples except for changing the amount of the added nigrosine dye in the range of from 0.5 to 2.5 parts by weight and the amount of the binder resin of styrene-n-butyl acrylate copolymer in the range of from 57.5 to 55.5 parts by weight so that the total amount becomes 100 parts by weight. A predetermined amount of each of these toners was dissolved in a predetermined amount of chloroform, and absorbance (wavelength: 567 nm) of the supernatant liquid of each solution was measured in the same manner as in Examples. The absorbance values were plotted in relation to the added amount, thus the calibration curve was prepared. In the case of forming the supernatant liquid, the magnetic powder can sufficiently be precipitated by allowing to stand the prepared solution on a magnet.

EXAMPLES 5, 6 AND

Comparative Examples 5 to 9

Contents of nigrosine in the chips, classified mother particles and classified fine powder were determined in the same manner as in Example 4 except for changing the charge controlling agent of nigrosine B to each of the nigrosine dyes described in Table 2. Results thus obtained are shown in Table 2.

TABLE 2

| | Charge controlling agent | Amount of nigrosine upon compounding (%) | Content of nigrosine in chips (%) | Content of nigrosine in toner mother powder (classified) (%) | Content of nigrosine in classified fine powder (%) | Distributing properties |
|---|---|---|---|---|---|---|
| Example 4 | Nigrosine dye B | 2.00 | 2.01 | 2.00 | 2.01 | uniformly distributed |
| Example 5 | Nigrosine dye C | 2.00 | 2.00 | 2.01 | 2.00 | uniformly distributed |
| Example 6 | Nigrosine dye D | 2.00 | 2.01 | 2.00 | 2.01 | uniformly distributed |
| Comparative Example 5 | Nigrosine dye A | 2.00 | 2.00 | 1.75 | 2.18 | poorly distributed |
| Comparative Example 6 | Nigrosine dye E | 2.00 | 2.00 | 1.79 | 2.11 | poorly distributed |
| Comparative Example 7 | Nigrosine dye F | 2.00 | 2.01 | 1.74 | 2.15 | poorly distributed |
| Comparative Example 8 | Nigrosine dye G | 2.00 | 2.01 | 1.74 | 2.19 | poorly distributed |
| Comparative Example 9 | Nigrosine dye H | 2.00 | 2.02 | 1.99 | 2.01 | uniformly distributed |

It is seen from Table 2 that the charge controlling agents of the invention (nigrosine dyes B, C and D) were contained in the chips, classified toner mother powder and classified fine powder in the same amount as that added upon compounding, thus showing good distributing properties into the binder resin. In contrast, the comparative nigrosine dyes (nigrosine dyes A, E, F, G and H) were contained in the toner mother powder in an amount less than that added upon compounding, whereas in the classified fine powder in an amount more than that added upon compounding, thus showing poor distributing properties. The poor distributing properties are presumed to be caused by the more amount of nitrobenzene and the more amount of aniline contained in the nigrosine dyes. It is also inferred that samples containing a less amount of residual solvent are favorable. The poor distributing properties prevents to produce a toner with a stable quality in the case of returning the classified fine powder to the starting materials, thus inhibiting re-use of the classified fine powder.

EXAMPLE 7

| | |
|---|---|
| Styrene-n-butyl acrylate copolymer | 88 parts by weight |
| Carbon black | 8 parts by weight |
| Nigrosine dye B | 2 parts by weight |
| Low molecular weight polypropylene wax | 2 parts by weight |

The above-described components were mixed in a Henschel mixer, then charged in a biaxial heating kneader, and the thus kneaded and extruded mixture was cooled at room temperature, followed by coarsely crushing with a hammer mill to obtain chips. Then, the chips were finely pulverized using a jet mill pulverizer, and guided to a classifier to take out a portion having an average particle size of 9 $\mu$m as a fine powder for a toner, thus a toner mother powder being obtained. 0.30 part by weight of hydrophobic silica (Aerosil R974) was added to 100 parts by weight of the toner mother powder and, after mixing in a Henschel mixer, change with time of the toner was examined under heating. The test on change with time of the toner under heating was conducted in the following manner. The toner was left for 24 hours in a 50° C. drier to accelerate heat deterioration, then mixed with a silicone-coated ferrite carrier having 100 $\mu$m of average particle size so that the toner concentration became 5% by weight, followed by continuously producing 5,000 actual copies under the conditions of 23° C. and 50% RH using a commercially available copier (copying machine FP7113 made by Matsusita Denso K. K.). Image density of the initial copy and that of 5,000th copy were 1.38 and 1.37, respectively, and fog of the initial copy and that of 5,000th copy were 0.8 and 0.7, respectively, thus not being changed in particular. In addition, no dusting of toner particles inside of the copying machine was observed after producing 5,000 copies, and the resultant image was not stained.

Additionally, fog was measured by measuring reflectivity at photo volt. A fog of 1.5% or less is a preferred value.

In addition, toner dusting inside of the copying machine was measured by checking whether dusting toner particles exist or not on a transfer charger. Dusting toner particles on the transfer charger would cause image stain.

EXAMPLES 8, 9 AND

Comparative Examples 10 to 14

The same procedures as described in Example 7 were conducted except for changing the charge controlling agent of nigrosine B to the nigrosine dyes shown in Table 3. Results thus obtained are shown in Table 3.

TABLE 3

| | Charge controlling agent | Image density Initial | Image density After 5,000 copies | Fog Initial | Fog After 5,000 copies | Toner dusting inside of a copier | Image stain | Results of change with time under heating |
|---|---|---|---|---|---|---|---|---|
| Example 7 | Nigrosine dye B | 1.38 | 1.37 | 0.8 | 0.7 | Not changed | Not changed | Not changed |
| Example 8 | Nigrosine dye C | 1.38 | 1.38 | 0.9 | 0.8 | Not changed | Not changed | Not changed |
| Example 9 | Nigrosine dye D | 1.39 | 1.38 | 1.0 | 1.1 | Not changed | Not changed | Not changed |
| Comparative Example 10 | Nigrosine dye A | 1.39 | 1.38 | 2.1 | 3.6 | Changed | Changed | Changed |
| Comparative Example 11 | Nigrosine dye E | 1.38 | 1.39 | 1.9 | 4.1 | Changed | Changed | Changed |
| Comparative Example 12 | Nigrosine dye F | 1.38 | 1.39 | 2.1 | 4.6 | Changed | Changed | Changed |
| Comparative Example 13 | Nigrosine dye G | 1.39 | 1.38 | 2.3 | 3.9 | Changed | Changed | Changed |
| Comparative Example 14 | Nigrosine dye H | 1.38 | 1.37 | 1.6 | 1.9 | Changed | Slightly Changed | Changed |

It is seen from Table 3 that, in the case of developing using the toner having been subjected to the accelerated heat-deteriorating test, no particular change was observed between the toner of the invention and the comparative toner in image density whereas, after the accelerated heat-deteriorating test, the toner of the invention did not suffer fog and dusting of toner inside of the copying machine upon producing 5,000 copies, with the comparative toner causing fog from the initial stage of copying and causing dusting of toner inside of the copying machine, thus image stain being observed. This may be attributed to the fact that uniform dispersibility of the nigrosine dye was spoiled due to the presence of large amounts of nitrobenzene and aniline. It is also inferred that a good dispersibility was obtained when the amount of residual solvent is small.

EXAMPLE 10

A magnetic toner powder having an average particle size of 9 $\mu$m was obtained in the same manner as in Example 4. 0.30 part by weight of hydrophobic silica (Aerosil R974) was added to 100 parts by weight of the magnetic toner, and the mixture was mixed in a Henschel mixer. Change with time of the toner under heating was examined in the same manner as in Example 7 by checking copied image density, state of fog in the image and dusting of toner inside of the copying machine after producing 5,000 copies. Actual copying test was conducted under the environmental conditions of 23° C. and 50% RH using a commercially available copier (copying machine NP-3050 made by Canon K. K.). Image density of the initial copy and that of 5,000th copy were 1.41 and 1.40, respectively, and fog of the initial copy and that of 5,000th copy were 0.9 and 0.8, respectively. In addition, no dusting of toner particles inside of the copying machine was observed after producing 5,000 copies, and the resultant image was not stained. Additionally, image density was measured using a Macbeth densitometer. It suffices that the image density is 1.3 or more.

EXAMPLES 11, 12 AND

Comparative Examples 15 to 19

The same procedures as described in Example 10 were conducted except for changing the charge controlling agent of nigrosine dye B to the nigrosine dyes described in Table 4. Results thus obtained are shown in Table 4.

TABLE 4

| | Charge controlling agent | Image density Initial | Image density After 5,000 copies | Fog Initial | Fog After 5,000 copies | Toner dusting inside of a copier | Results of change with time under heating |
|---|---|---|---|---|---|---|---|
| Example 10 | Nigrosine dye B | 1.41 | 1.40 | 0.9 | 0.8 | Not changed | Not changed |
| Example 11 | Nigrosine dye C | 1.41 | 1.38 | 0.7 | 0.8 | Not changed | Not changed |
| Example 12 | Nigrosine dye D | 1.39 | 1.39 | 0.8 | 0.9 | Not changed | Not changed |
| Comparative Example 15 | Nigrosine dye A | 1.35 | 1.26 | 1.8 | 2.4 | Slightly changed | Changed |
| Comparative Example 16 | Nigrosine dye E | 1.34 | 1.25 | 1.9 | 2.9 | Slightly changed | Changed |
| Comparative Example 17 | Nigrosine dye F | 1.35 | 1.27 | 1.9 | 2.6 | Slightly changed | Changed |
| Comparative Example 18 | Nigrosine dye G | 1.32 | 1.24 | 1.6 | 2.1 | Slightly changed | Changed |
| Comparative Example 19 | Nigrosine dye H | 1.34 | 1.31 | 1.4 | 1.8 | Slightly changed | Changed |

It is seen from Table 4 that, in the case of developing using the toner having been subjected to the accelerated heat-deteriorating test, the toner of the invention provided the same image density as that at the initial stage after producing 5,000 copies and caused no increase in fog. On the other hand, with the comparative toners, though initial image density was at an allowable level, a decrease in image density occurred with an increase in number of produced copies assumptively due to non-uniform disperse of the nigrosine dyes, and fog was formed from the start of copying, and became more and more serious after producing 5,000 copies. As to dusting of toner inside of the copying machine, the toners of the invention caused no toner dusting, but the comparative toners caused some dusting.

As has been described hereinbefore, a toner for developing electrostatic charge images containing a uniformly dispersed nigrosine dye can be obtained by using as a charge controlling agent for a toner for developing electrostatic charge images the nigrosine dye of the present invention having low contents of nitrobenzene and aniline and having been treated with an oxidizing agent and the low-boiling solvent. This toner can provide a fog-free copied image having a good image density from the start and, even in the case of producing many copies, causes no decrease in image density. In addition, the toner of the invention for developing electrostatic charge images suffers no change with time under heating, and thus there is obtained a good toner which undergoes no change in characteristics due to heat stress before being marketed, during storage after being bought or during transportation. Further, the charge controlling agent of the present invention has such good distributing properties that re-use of the classified fine powder is possible, which greatly contributes to saving of resources and reduction in cost upon production of the toner.

Although the invention has been described with respect to specific embodiments, the details are not to be construed as limitations, for it will be apparent that various embodiments, changes and modifications may be made without departing from the spirit and scope of the present invention, and it is understood that such equivalent embodiments are intended to be included within the scope of this invention.

What is claimed is:

1. A toner for developing electrostatic charge images containing at least a binder resin, a colorant and a charge controlling agent, which contains as a charge controlling agent a nigrosine dye or a nigrosine pigment containing 500 ppm or less nitrobenzene and 800 ppm or less aniline.

2. The toner for developing electrostatic charge images as described in claim 1, wherein the nigrosine dye or the nigrosine pigment containing 500 ppm or less nitrobenzene and 800 ppm or less aniline is that obtained by dispersing the nigrosine dye or the nigrosine pigment in a solvent, and adding thereto an oxidizing agent to conduct oxidation treatment.

3. The toner for developing electrostatic charge images as described in claim 2, wherein the oxidizing agent is bleaching powder or sodium hypochlorite, and the solvent is a solvent having a boiling point of 100° C. or lower than that.

4. The toner for developing electrostatic charge images as described in claim 3, wherein the solvent is methanol.

5. The toner for developing electrostatic charge images as described in claim 2, wherein the nigrosine dye or the nigrosine pigment containing 500 ppm or less nitrobenzene and 800 ppm or less aniline is that obtained by further subjecting to steam distillation after the addition of the oxidizing agent.

6. The toner for developing electrostatic charge images as described in claim 5, wherein the oxidizing agent is bleaching powder or sodium hypochlorite, and the solvent is a solvent having a boiling point of 100° C. or lower than that.

7. The toner for developing electrostatic charge images as described in claim 6, wherein the solvent is methanol.

8. A charge controlling agent to be used for the toner for developing electrostatic charge images, which comprises a nigrosine dye or a nigrosine pigment containing 500 ppm or less nitrobenzene and 800 ppm or less aniline.

9. A process for producing a nigrosine dye or a nigrosine pigment, which comprises dispersing a nigrosine dye or a nigrosine pigment in a solvent, and adding thereto an oxidizing agent to conduct oxidation treatment to thereby produce a nigrosine dye or a nigrosine pigment containing 500 ppm or less nitrobenzene and 800 ppm or less aniline.

10. The process for producing a nigrosine dye or a nigrosine pigment as described in claim 9, wherein the oxidizing agent is bleaching powder or sodium hypochlorite and the solvent is a solvent having a boiling point of 100° C. or lower than that.

11. The process for producing a nigrosine dye or a nigrosine pigment as described in one of claims 10, wherein the solvent is methanol.

12. The process for producing a nigrosine dye or a nigrosine pigment as described in claim 9, wherein steam distillation is further conducted after adding thereto an oxidizing agent.

13. The process for producing a nigrosine dye or a nigrosine pigment as described in claim 12, wherein the oxidizing agent is bleaching powder or sodium hypochlorite and the solvent is a solvent having a boiling point of 100° C. or lower than that.

14. The process for producing a nigrosine dye or a nigrosine pigment as described in claim 13, wherein the solvent is methanol.

* * * * *